US008317043B2

(12) United States Patent
Smith et al.

(10) Patent No.: US 8,317,043 B2
(45) Date of Patent: Nov. 27, 2012

(54) BEVERAGE CONTAINERS

(75) Inventors: Matthew Eric Smith, Ballaugh (GB); Karl Mondszein, Mansfield (GB)

(73) Assignee: Carbonite Corporation, Panama (PA)

( * ) Notice: Subject to any disclaimer, the term of this patent is extended or adjusted under 35 U.S.C. 154(b) by 26 days.

(21) Appl. No.: 10/593,836

(22) PCT Filed: Mar. 16, 2005

(86) PCT No.: PCT/GB2005/000986

§ 371 (c)(1),
(2), (4) Date: Jun. 15, 2007

(87) PCT Pub. No.: WO2005/092732

PCT Pub. Date: Oct. 6, 2005

(65) Prior Publication Data

US 2008/0041808 A1 Feb. 21, 2008

(30) Foreign Application Priority Data

Mar. 25, 2004 (GB) ..... 0406762.5

(51) Int. Cl.
*B65D 41/48* (2006.01)
*B65D 41/52* (2006.01)

(52) U.S. Cl. ..... 215/321; 215/317; 215/253; 220/795; 220/780

(58) Field of Classification Search ..... 215/252, 215/253, 317, 321; 220/287, 780, 796
See application file for complete search history.

(56) References Cited

U.S. PATENT DOCUMENTS

| | | | | | |
|---|---|---|---|---|---|
| 4,106,653 | A | * | 8/1978 | Martinelli | 215/256 |
| 4,501,371 | A | * | 2/1985 | Smalley | 215/232 |
| 4,522,308 | A | * | 6/1985 | Sullivan | 215/253 |
| 4,640,435 | A | | 2/1987 | Dutt | |
| 4,732,289 | A | * | 3/1988 | Granat et al. | 215/252 |
| 4,793,510 | A | * | 12/1988 | Arfert et al. | 220/793 |
| RE33,265 | E | * | 7/1990 | Gregory et al. | 215/252 |
| 4,978,016 | A | * | 12/1990 | Hayes | 215/252 |

(Continued)

FOREIGN PATENT DOCUMENTS

| | | |
|---|---|---|
| GB | 1163203 | 2/1967 |
| GB | 2 143 221 | 2/1985 |
| GB | 2 363 114 | 12/2001 |
| WO | 96/19388 | 6/1996 |
| WO | 00/56618 | 9/2000 |

*Primary Examiner* — Anthony Stashick
*Assistant Examiner* — James N Smalley
(74) *Attorney, Agent, or Firm* — Cowan, Liebowitz & Latman

(57) ABSTRACT

A beverage container comprises a receptacle (2) which has a central axis (3) and is sealed by a lid (6) of resilient material. The receptacle includes a neck (8) defining an opening and the lid includes a closure plate (30, 32), integral with which is a depending skirt (18) extending around the outer surface of the neck. The inner surface of the skirt (18) carries a continuous annular flange (20), which is in sealing engagement with the underside of a continuous downwardly directed annular shoulder (14) on the outer surface of the neck and thus prevents movement of the lid in the axial direction away from the receptacle. The annular flange (20) on the lid is connected thereto by a resilient hinge connection (22). The annular flange (20) is elongate in axial sectional view. The end surface of the free end of the flange (20) is in sealing engagement with the underside of the shoulder (14) and the resilience of the resilient hinge connection (22) urges the side surface of the free end of the annular flange (20) into sealing engagement with the external surface of the neck.

13 Claims, 3 Drawing Sheets

U.S. PATENT DOCUMENTS 5,103,990 A * 4/1992 Irwin ..... 215/320
5,145,084 A * 9/1992 Murayama et al. ..... 220/260
5,271,517 A 12/1993 Bowers
5,452,818 A * 9/1995 Yost ..... 220/258.2
5,875,908 A * 3/1999 Witt et al. ..... 215/256
5,996,833 A 12/1999 Lencioni et al.
6,085,921 A 7/2000 Brown
6,286,702 B1 * 9/2001 Buermann ..... 220/229
6,854,616 B2 * 2/2005 Steffan ..... 220/270
2003/0071043 A1 4/2003 Davis

* cited by examiner

BEVERAGE CONTAINERS

CROSS-REFERENCES TO RELATED APPLICATIONS

This application claims priority to International Application No. PCT/GB2005/00986 filed Mar. 16, 2005, which claims priority to Great Britain Application No. 0406762.5, the entire disclosures of which are hereby incorporated by reference.

The present invention relates to containers for beverages, particularly carbonated beverages, and is concerned in particular with such containers with wide mouths, that is to say with a diameter in excess of about 25 mm, preferably about 38 mm, more particularly 45 mm.

Beverage bottles typically have a narrow mouth with a diameter in the region of only 28 mm or less. Numerous ways of sealing the bottle top to the neck of the bottle are known but it will be appreciated that the problem of producing a seal on a container for a carbonated beverage increases exponentially as the diameter of the mouth increases because the area of the underside of the cap or top increases in accordance with the square of the radius. If the container cap or its seal should fail, the gas pressure will be released and the cap may even be projected explosively into the air with the resultant loss of the beverage and potential injury to bystanders. Similar sealing problems can arise also with uncarbonated beverages because if the container is subjected to an elevated temperature, e.g. it is exposed to direct sunlight, the gas pressure in the head space of the container will increase and if the container is inadequately sealed this will result in the leakage of gas to the atmosphere. This is not of itself inherently problematic, but when the container cools again, a subatmospheric pressure may be produced in the head space which results in the induction of atmospheric oxygen. This can result in oxidation of the container contents rendering them undrinkable.

GB-A-1163203 discloses a beverage container comprising a receptacle which has a central axis and sealed by a lid of resilient material. The receptacle includes a neck defining an opening and the lid includes a closure plate, integral with which is a depending skirt extending around the outer surface of the neck. The inner surface of the skirt carries a continuous annular flange which is in sealing engagement with the underside of a continuous downwardly directed annular shoulder on the outer surface of the neck and thus prevents movement of the lid in the axial direction away from the receptacle.

The annular flange is very short and is more in the nature of a protuberance and the shoulder which it engages is inclined at about 45° to the horizontal. The retaining function of the flange on the shoulder is thus not very secure and the lid could readily be dislodged or the gas seal broken by an impact.

It is the object of the invention to provide such container, particularly of wide mouthed type, with a reliably sealed lid which can contain the pressure generated by a carbonated beverage or generated under high ambient temperature conditions in the head space of a container containing an uncarbonated beverage or foodstuff but which can nevertheless be rapidly and simply removed, when required.

According to the present invention, there is provided a beverage container, particularly for carbonated beverages, comprising a receptacle which has a central axis and is sealed by a lid of resilient material, the receptacle including a neck defining an opening and the lid including a closure plate, integral with which is a depending skirt extending around the outer surface of the neck, the inner surface of the skirt carrying a continuous annular flange, which is in sealing engagement with the underside of a continuous downwardly directed annular shoulder on the outer surface of the neck and thus prevents movement of the lid in the axial direction away from the receptacle, characterised in that the annular flange on the lid is connected thereto by a resilient hinge connection, that the annular flange is elongate in axial sectional view, that the end surface of the free end of the flange is in sealing engagement with the underside of the shoulder and that the resilience of the resilient hinge connection urges the side surface of the free end of the annular flange into sealing engagement with the external surface of the neck.

Thus the lid is retained on the receptacle by an annular flange which is integral with the inner surface of the skirt and which preferably extends substantially parallel to the skirt, the free end of which engages the underside of a shoulder on the neck of the bottle, which preferably extends substantially perpendicular to the axis of the receptacle. This engagement not only prevents movement of the lid and the receptacle away from one another but also constitutes a gas seal. The resilience of the connection between the annular flange and the skirt urges the side surface of the free end of the flange inwardly into engagement with the outer surface of the neck under a contact pressure. A further seal is thus formed.

The gas seal between the end of the annular flange and the underside of the shoulder is maintained in practice as a result of the fact that the skirt is in tension, which draws the free end of the flange into contact with the underside of the annular shoulder. The necessary reactive force is provided by engagement of the underside of the lid with the upper surface of the neck. If, as is preferred, this upper surface is smooth and continuous, then it is preferred that the closure plate is connected to the annular skirt by an annular web, the underside of which extends over the upper surface of the neck and is retained in sealing engagement with it.

In order to maintain the integrity of the gas seal between the underside of the web and the upper surface of the rim, the annular skirt is preferably stressed in tension by the method by which the cap is applied to the bottle, as will be discussed below. This tension draws the underside of the web into sealed engagement with the upper surface of the neck and also draws the free end of the annular flange on the lid into sealing engagement with the downwardly directed annular shoulder on the outer surface of the neck. The seal between the underside of the web and the upper surface of the neck is sufficient to retain a relatively high pressure within the bottle but if this pressure should rise to an unusually high level or if the lid should be deformed by the application of an external force, pressurised gas may flow past this seal and into the space defined by the exterior of the neck of the bottle, the dependent skirt and the annular flange connected to the skirt. This pressure will act on the flange and force it inwardly, that is to say towards the external surface of the neck, thereby increasing the contact pressure between the flange and the external surface of the neck and thus increasing the integrity of the further gas seal between these components.

In order that the lid may be readily removed from the bottle, when desired, it is preferred that the resilient connection of the annular flange to the skirt is readily tearable. It is also preferred that the lid is snap-fitted on the receptacle. In order to facilitate removal of the cap, it is preferred that it includes a rupture tab connected to the annular web, rotation of which causes the seal of the container to be broken and the snap-fit connection to be released. It is, however, also possible for the rupture tab to be omitted and for the cap to be removed by a bottle opener of the conventional type used with crown bottle tops.

Thus the container in accordance with the invention has a first gas seal between the free end of the annular flange connected to the skirt and the downwardly directed surface on the shoulder of the exterior of the rim and a second gas seal between the side surface of the free end of the annular flange and the external surface of the neck and preferably also a third gas seal between the underside of the lid, that is to say the underside of the web which connects the closure plate to the annular skirt, and the upper surface of the neck. If yet a further gas seal is thought to be necessary or desirable, the closure plate may be downwardly concave and thus extends into the neck and includes a base portion, integral with which is an upwardly extending wall portion which is connected to the annular web. The bottle and cap may then be so constructed and dimensioned that the inner surface of the neck constitutes a first annular sealing surface and the outer surface of the wall portion of the closure plate constitutes a second sealing surface which is opposed to and in sealing engagement with the first sealing surface. It is preferred in this event that the base portion of the closure plate is downwardly concave. In the event of a gas pressure being generated in the head space of the container, the concave portion of the lid will be deformed upwardly and this will inherently result in a force acting on that portion of the lid which affords the second sealing surface, which urges it against the corresponding first sealing surface on the neck of the receptacle. Accordingly, as the gas pressure rises in the receptacle, the integrity or sealing ability of this further gas seal increases also.

The first sealing surface may be inclined upwardly and outwardly with respect to the axis but alternatively or additionally, one of the first and second sealing surfaces may carry an annular protuberance which is accommodated within an annular recess on the other of the first and second sealing surfaces. The provision of such a mating protuberance and recess means that if the closure plate of the cap should move upwardly with respect to the receptacle, the contact pressure of a portion of the protuberance with a portion of the surface of the recess will increase, thereby increasing its sealing integrity.

Further features and details of the invention will be apparent from the following description of two specific embodiments which is given by way of example only with reference to the accompanying diagrammatic drawings, in which.

Figure 1:
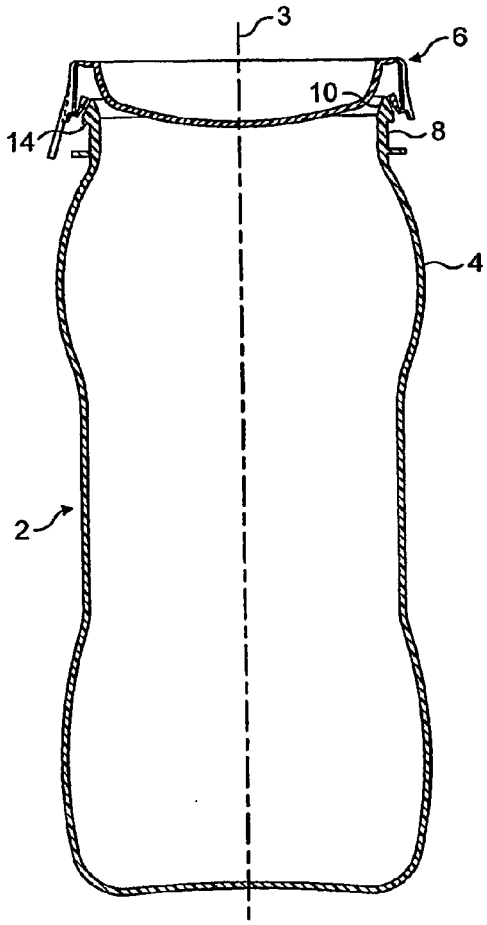
FIG. 1 is a vertical sectional view of a first embodiment of a beverage bottle in accordance with the invention with the lid in an intermediate position whilst being applied to the bottle.

As seen in FIG. 1, the bottle 2 is of generally cylindrical shape with an axis 3 and at least one portion 4 of increased size whose diameter is greater than that of the lid 6, for reasons which will be explained below. The bottle is in this case moulded from plastic material and it has a wide mouth, with a diameter of greater than 28 mm defined by the neck 8 of the bottle. The neck 8 terminates at a rim portion which is defined by an internal surface 10, which is inclined upwardly and outwardly with respect to the axis 3, and an external surface 12, which is inclined upwardly and inwardly with respect to the axis 3. The surfaces 10 and 12 thus converge and the external diameter of the bottle, specifically of its rim portion, thus initially increases from the top downwards. However, it then decreases abruptly at a downwardly directed annular shoulder 14 extending substantially perpendicular to the axis 3. The internal diameter of the rim portion, however, initially decreases from the top downwards.

Figure 2:
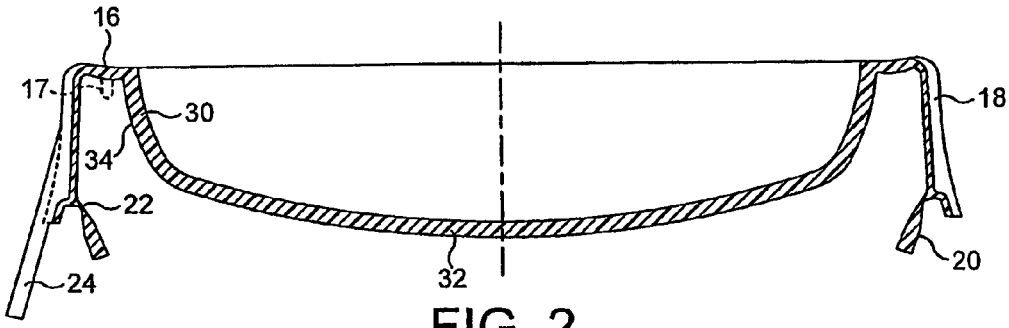
FIG. 2 is a vertical sectional view of the container lid before application to the bottle.

As best seen in FIG. 2, the lid comprises a one-piece component, preferably integrally moulded from resilient plastic material, such as polypropylene. It comprises a shaped closure plate, integral with which is a web 16 which extends, when the lid is connected to the bottle, over the rim of the bottle. Integral with the web 16 is a depending skirt 18, which extends downwardly around the exterior of the upper portion of the bottle. Integrally connected to the lower edge of the skirt 18 or to the inner surface of the skirt at a position adjacent its lower edge is an annular retaining flange 20. The flange 20 is elongate in axial sectional view and is connected to the skirt 18 by a resilient connecting web 22, which is of reduced thickness and thus constitutes an annular line of weakness or predetermined breaking point. Connected to the lid at one circumferential position is a rupturing tab 24 which extends downwardly below the lower edge of the skirt 18. This tab is connected to the skirt 18 at its side by two lines of weakness 26, i.e. regions of reduced thickness.

The closure plate of the lid is concave and thus extends into the neck of the bottle, when it is connected to the bottle. The closure plate comprises a wall portion 30 which extends generally downwardly and inwardly and merges at its lower edge with a base portion 32, which is downwardly accurate, that is to say is of downwardly curved convex shape.

The lid is shown in FIG. 2 in the configuration in which it is moulded. In this configuration, the flange 20 extends downwardly and inwardly and the diameter of its lower edge is less than that of the upper edge of the rim of the bottle whilst the diameter of its upper edge is greater than that of the upper edge of the rim of the bottle.

Figure 3:
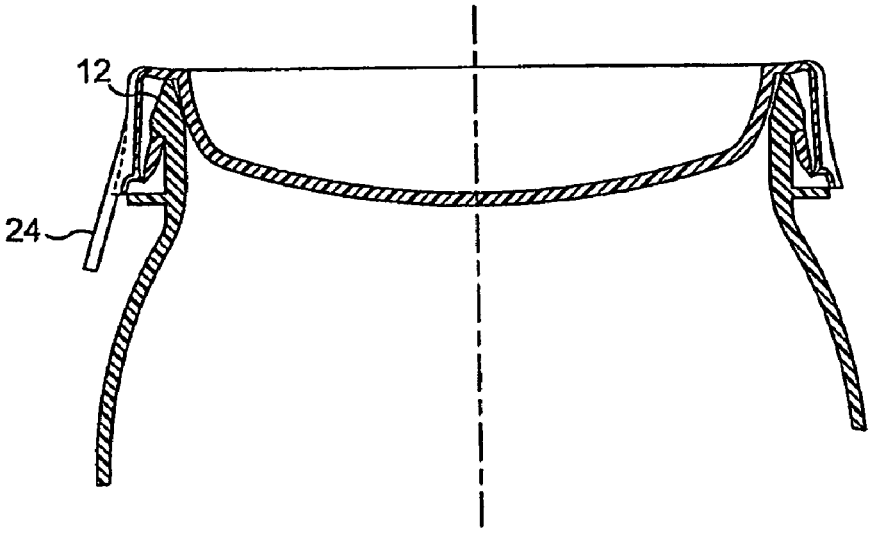
FIG. 3 is a scrap sectional view of the upper portion of the bottle showing the lid in the applied and sealed position.
Figure 4:
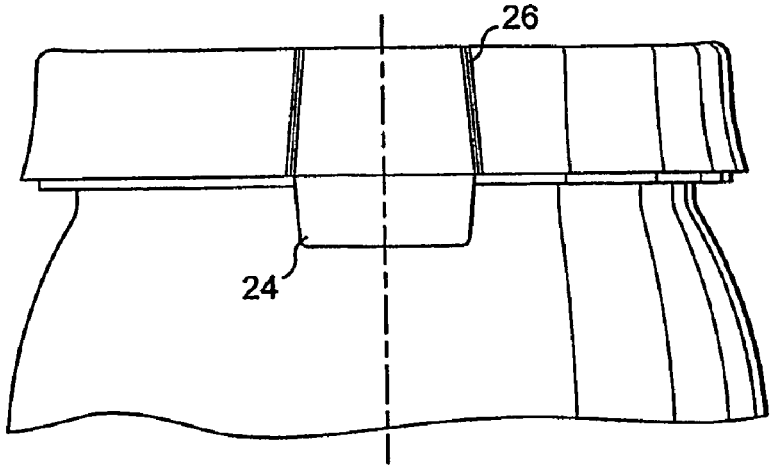
FIG. 4 is a side view of the upper portion of the bottle as seen in FIG. 3.
Figure 5:
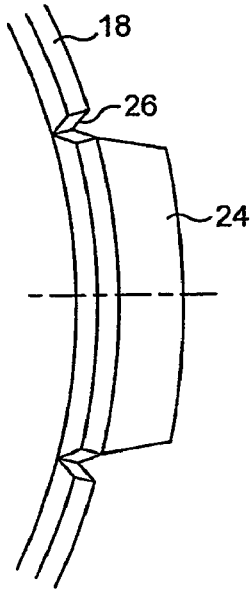
FIG. 5 is a scrap view from below of part of the lid showing the rupturing tab.

The lid is fastened and sealed to the bottle by a simple snap-fit procedure. This is effected simply by lowering the lid into the rim of the boffle and then applying pressure. As the lid is lowered, the lower edge of the flange 20 comes into contact with the rim. This causes the flange to rotate inwardly about the web 22. As downward movement of the lid continues, the flange 20 moves downwardly in contact with the surface 12, as shown in FIG. 1, and the increasing diameter of this surface in the downward direction results in the rotation of the flange continuing, thus moving it ever closer to the inner surface of the skirt 18. The underside of the web 16 then contacts the upper surface of the rim of the bottle. However, the pressure on the cap is maintained and this results in slight deformation of the web 16. The cap and bottle are so dimensioned that the slight further downward movement of the cap caused by the deformation of the web 16, is sufficient to permit the free end of the flange 20 to move past the shoulder 14. It is then rotated in the opposition direction, i.e. inwardly, by the resilience of the web 22 and thus becomes locked behind the shoulder, as shown in FIG. 3. The lid is now retained in position on the bottle and cannot be removed without damaging or deforming it. The tension maintains the underside of the web 16 in engagement with the upper surface of the rim with a contact pressure sufficient to ensure that a first gas seal is formed along the annular line of contact. The tension in the skirt 18 also maintains the free end of the flange 20 in engagement with the surface of the shoulder 14 with a contact pressure sufficient to ensure that a second gas seal is formed along the annular line of contact. Furthermore, the resilience of the connecting web 22 forces the side surface of the free end of the flange 20 into contact with the side surface of the bottle and the contact pressure is preferably sufficient to form a third gas seal. The integrity of the first gas seal may be further enhanced, if required, by the provision of an annular bead or flange 17, which is shown in phantom lines only on the left-hand side in FIG. 2 and which will engage the side surface of the rim of the bottle and constitute an additional lip seal. This bead 17 is positioned and dimensioned so that it is deformed laterally by contact with the rim of the bottle and thus urged by its resilience into contact with the side surface of the rim and thus forms a further seal. If the pressure in the bottle should rise to a high value sufficient to deform the cap away from the rim of the bottle, thereby breaking the first gas seal, pressurised gas will flow into the space defined by the outer surface of the rim, the skirt 18 and the flange 20. This pressure will act on the flange 20 to press it yet more firmly against the side surface of the rim, thereby increasing the integrity of the third gas seal.

If yet further sealing integrity is required, yet a further gas seal may be provided, as in the illustrated embodiment, between the surface 10 of the rim and the outer surface 34 of the wall portion 30. Thus in this embodiment, these two surfaces are formed as complementary sealing surfaces in sealing engagement with one another. If the pressure in the bottle should become super-atmospheric, either as a result of the liberation of carbon dioxide from a carbonated beverage or as a result of the expansion of gas in the head space of the bottle due to an increase in temperature, the centre of the concave base portion 32 will be deformed upwardly and this will inherently result in the outer edge of the base portion 32 and thus the lower edge of the wall portion 30 moving slightly outwards. This will result in an increase in the contact pressure between the sealing surfaces 12 and 34 and thus in an enhancement to the integrity of this further gas seal. The beverage container in accordance with the invention therefore not only has both primary and secondary gas seals but also has a further gas seal. The integrity or sealing ability of this further seal increases as the gas pressure within the container increases.

When it is desired to open the bottle, the user merely grasps the lower edge of the rupture tab 24 and pulls it outwardly. The lines of weakness 26 immediately rupture or stretch and the upper edge of the tab 24, which is connected to the web 16, rotates, thereby breaking the second and third gas seals. This rotation is transmitted to the web 16, which thus moves away from the rim of the bottle, thus breaking the first gas seal. This movement of the web 16 also causes the sealing surfaces 12 and 34 locally to move apart, thereby also breaking the further gas seal. The container is thus depressurised. The outward movement of the tab 24 initiates tearing of the thin connecting web 22, and once tearing has started it is a simple matter to keep it going by exerting upward and outward pressure on the tab 24 until the lid is completely disconnected from the flange 20, which remains in position around the neck of the bottle. The lid may now be discarded and the contents of the bottle dispensed or drunk.

As mentioned above, the body of the bottle has one or more protuberances 4 whose contour extends beyond that of the lid, when viewed in the axial direction. This means that when a number of such bottles are packaged together side by side, they will contact one another only at the protuberances and the lids of adjacent bottles will not contact one another, thereby eliminating the risk that the lids may inadvertently become dislodged, thereby venting the interior of the associated containers. The base of the bottle also has a shape which is complementary to that of the upper surface of the lid so that bottles may be simply and securely stacked on top of one another.

Figure 6:
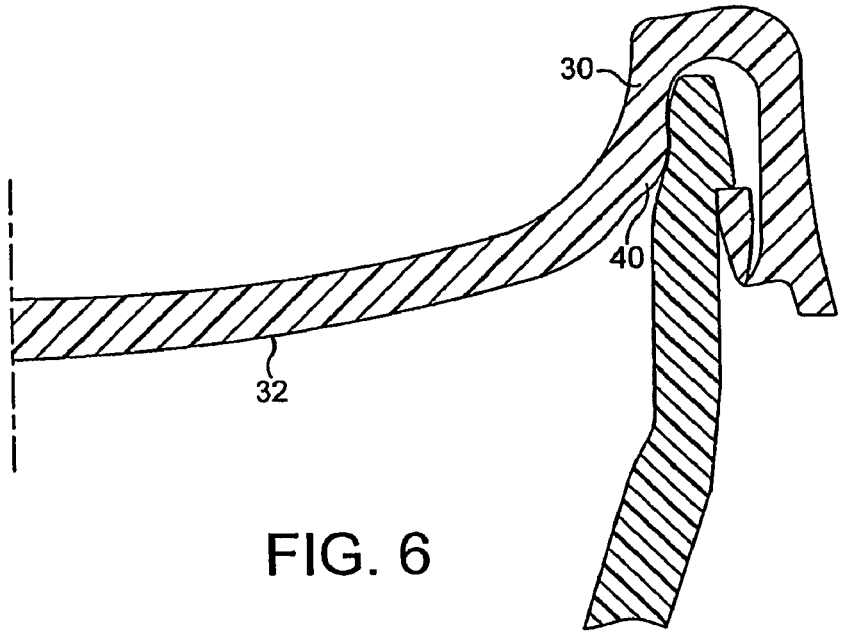
FIG. 6 is a scrap view of the lid and bottle in accordance with a second embodiment.

In the modified embodiment illustrated in FIG. 6, the outer surface of the wall portion 30 carries an annular protuberance 40, which engages the surface of a recess in the internal surface of the rim. If the gas pressure within the bottle should increase to a level sufficient to deform the lid upwardly to an extent sufficient to break the first gas seal, as is illustrated, the contact pressure of the upper portion of the protuberance with the surface of the recess will be increased, thereby increasing the integrity of the further gas seal, and compensate for the loss of the first gas seal. The protuberance could also be carried by the inner surface of the rim, in which case the recess will be formed in the wall portion 30. If the gas pressure in the container should increase substantially, it will be the contact pressure of the lower portion of the protuberance which will increase.

Although the container of the present invention is intended primarily for beverages, i.e. for liquids that are intended to be drunk, it will be appreciated that it will be equally applicable to other flowable foodstuffs, such as yoghurt and the term "beverage" is to be interpreted accordingly.

This invention claimed is:

1. A beverage container comprising:

a receptacle having a central axis, a neck that defines an opening and a resilient lid having a closure plate which plate spans the opening of the neck, a downwardly facing annular shoulder on the outer surface of the neck, the lid having an annular web extending over the upper end of the neck, an annular skirt extending downwardly from the outer end of said web, an annular flange integral with the lower end of the skirt, a resilient hinge connecting the flange to the lower end of the skirt, the flange having a distal free end, the flange being rotatable from a downwardly extending position having the free end facing away from the web in an unassembled state to an upwardly extending position having the free end facing the web in an assembled state, the upper edge of the neck deforming the web, the upwardly facing free end of the flange engaging the downwardly facing shoulder, the skirt being in tension between the shoulder and the free end of the flange, the resilient hinge forcing the side surface of the flange against a side surface of the container, a first gas seal provided by the web deforming engagement of the web and the upper end of the neck, a second gas seal provided by the engagement of the free end of the flange in the upwardly facing position and the shoulder, and a third gas seal provided by engagement between the side surface of the free end of the flange and the side surface of the receptacle under force provided by the resilience of said hinge.

2. The container of claim 1 in which the resilient hinge is readily tearable.

3. The container of claim 1 in which the lid is snap-fitted on the receptacle.

4. The container of claim 3 further comprising: a rupture tab connected to the annular web, rotation of the rupture tab causing the seal of the container to be broken and the snap-fit connection to be released.

5. The container of claim 1 in which the closure plate is downwardly concave and thus extends into the neck and includes a base portion, integral with which is an upwardly extending wall portion, which is connected to the annular web.

6. The container of claim 5 in which the inner surface of the neck and the outer surface of the wall portion of the closure plate are first and second surfaces in sealing engagement with each other.

7. The container of claim 6 in which the sealing engagement is along an annular surface that is inclined upwardly and outwardly with respect to the axis.

8. The container of claim 6 in which one of the first and second sealing surfaces carries an annular protuberance which is accommodated within an annular recess in the other of the first and second sealing surfaces.

9. The container of claim 1 in which the annular flange that is integral with the underside of the annular web is deflected laterally by contact with the side surface of the neck of the bottle, with which it forms the third gas seal.

10. The container of claim 1 in which the lid is snap-fitted on the receptacle, the closure plate is downwardly concave and thus extends into the neck and includes a base portion, integral with which is an upwardly extending wall portion which is connected to the annular web, and including a rupture tab connected to the annular web, rotation of which causes the seal of the container to be broken and the snap-fit connection to be released.

11. The container of claim 10 in which one of the first and second sealing surfaces carries an annular protuberance which is accommodated within an annular recess in the other of the first and second sealing surfaces, and in which an annular flange is integral with the underside of the annular web and is deflected laterally by contact with the side surface of the neck of the bottle, with which it forms a further seal.

12. The container of claim 1 in which a thickness of the flange increases with distance from the hinge.

13. The container of claim 9 in which a thickness of the flange increases with distance from the hinge.

* * * * *